US009080582B2

(12) United States Patent
Fukuda et al.

(10) Patent No.: US 9,080,582 B2
(45) Date of Patent: Jul. 14, 2015

(54) CIRCUIT PRESSURE CONTROL DEVICE, HYDRAULIC CONTROL CIRCUIT USING CIRCUIT PRESSURE CONTROL UNIT, AND HYDRAULIC CONTROL CIRCUIT OF CONSTRUCTION MACHINE

(71) Applicant: KAYABA INDUSTRY CO., LTD., Tokyo (JP)

(72) Inventors: Shunsuke Fukuda, Sagamihara (JP); Nobuyoshi Yoshida, Tokyo (JP)

(73) Assignee: KAYABA INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/373,374

(22) PCT Filed: Jan. 21, 2013

(86) PCT No.: PCT/JP2013/051091
§ 371 (c)(1),
(2) Date: Jul. 21, 2014

(87) PCT Pub. No.: WO2013/111705
PCT Pub. Date: Aug. 1, 2013

(65) Prior Publication Data

US 2015/0013323 A1 Jan. 15, 2015

(30) Foreign Application Priority Data

Jan. 25, 2012 (JP) ..... 2012-013186

(51) Int. Cl.
*F15B 11/028* (2006.01)
*F15B 13/10* (2006.01)
(Continued)

(52) U.S. Cl.
CPC ..... *F15B 13/10* (2013.01); *E02F 9/123* (2013.01); *E02F 9/225* (2013.01); *E02F 9/2225* (2013.01); *E02F 9/2296* (2013.01); *F15B 11/028* (2013.01); *F15B 21/14* (2013.01); *F15B 2211/20546* (2013.01); *F15B 2211/40515* (2013.01); *F15B 2211/413* (2013.01); *F15B 2211/41581* (2013.01);
(Continued)

(58) Field of Classification Search
CPC ..... F15B 11/028; F15B 21/14; F15B 2211/5153; F15B 2211/55; F15B 2211/50518
USPC ..... 60/414, 459; 91/447
See application file for complete search history.

(56) References Cited

U.S. PATENT DOCUMENTS 4,320,812 A * 3/1982 Takaoka et al. ..... 91/458
4,512,238 A * 4/1985 Bacardit ..... 91/434
(Continued)

FOREIGN PATENT DOCUMENTS

CN 2936702 Y 8/2007
DE 2037626 A1 2/1972
(Continued)

OTHER PUBLICATIONS

Extended European Search Report dated Feb. 25, 2015.

*Primary Examiner* — Thomas E Lazo
(74) *Attorney, Agent, or Firm* — Rabin & Berdo, P.C

(57) ABSTRACT

A circuit pressure control unit includes a relief valve and a variable throttle valve. The relief valve is connected to a connecting passage communicating with an actuator upstream. The variable throttle valve is disposed upstream of the relief valve and is configured to change an opening degree thereof according to a control signal from a controller.

6 Claims, 2 Drawing Sheets

(51) Int. Cl.

| | |
|---|---|
| ***F15B 21/14*** | (2006.01) |
| ***E02F 9/12*** | (2006.01) |
| ***E02F 9/22*** | (2006.01) |

(52) U.S. Cl.

CPC *F15B 2211/426* (2013.01); *F15B 2211/50518* (2013.01); *F15B 2211/5159* (2013.01); *F15B 2211/55* (2013.01); *F15B 2211/611* (2013.01); *F15B 2211/6313* (2013.01); *F15B 2211/6346* (2013.01); *F15B 2211/6653* (2013.01); *F15B 2211/7058* (2013.01); *F15B 2211/88* (2013.01); *Y10T 137/7837* (2015.04)

(56) References Cited

U.S. PATENT DOCUMENTS

| | | | | | |
|---|---|---|---|---|---|
| 4,594,936 | A | * | 6/1986 | Bacardit | 91/467 |
| 4,665,798 | A | * | 5/1987 | Bacardit | 91/434 |
| 5,038,878 | A | * | 8/1991 | Uchida et al. | 91/375 A |
| 5,125,323 | A | | 6/1992 | Yonezawa | |
| 5,873,245 | A | | 2/1999 | Kato et al. | |

FOREIGN PATENT DOCUMENTS

| | | | |
|---|---|---|---|
| DE | 1482814 | | 8/1977 |
| GB | 1482814 | | 8/1977 |
| JP | 63-214505 | A | 9/1988 |
| JP | 04-073410 | | 3/1992 |
| JP | 1994-174122 | A | 6/1994 |
| JP | 2011-017427 | A | 1/2011 |
| KR | 2009-0124885 | A | 12/2009 |
| KR | 2010-0137421 | A | 12/2010 |
| WO | WO 2011/004879 | A1 | 1/2011 |

* cited by examiner

CIRCUIT PRESSURE CONTROL DEVICE, HYDRAULIC CONTROL CIRCUIT USING CIRCUIT PRESSURE CONTROL UNIT, AND HYDRAULIC CONTROL CIRCUIT OF CONSTRUCTION MACHINE

TECHNICAL FIELD OF THE INVENTION

The present invention relates to a circuit pressure control device that linearly controls a driving pressure of an actuator, a hydraulic control circuit that linearly controls a driving pressure of an actuator to be controlled and can supply another actuator with residual oil of the actuator to be controlled at the same time, and a hydraulic control circuit for a construction machine.

BACKGROUND OF THE INVENTION

As a device that controls a driving pressure of an actuator, a relief valve is known. This relief valve sets a maximum high pressure using a spring force of a spring and controls circuit pressure by communicating the circuit with a tank when a pressure equal to or more than the maximum high pressure is applied. As a component that changes the setting pressure, for example, as disclosed in JP1994-174122A, A device with an auxiliary piston disposed at the spring where pressure is applied to the auxiliary piston, the spring is bent, and an initial setting pressure is changeable is generally known.

On the other hand, in a construction machine, for example, as a device that controls a driving pressure of a rotating motor, a device disclosed in JP2011-017427A is known.

This type of device includes relief valves. The relief valves, which control driving pressure of the rotating motor, are connected in parallel with a pair of connecting passages. The pair of connecting passages allow the rotating motor to communicate with the hydraulic pump or the tank. The relief valves include an open/close valve at upstream. The relief valve couples a hydraulic motor for rotating an electric generator at downstream.

The setting pressure of the relief valve is set lower than that of a main relief valve that controls the maximum high pressure of the entire circuit.

If the rotating motor has a surplus driving pressure, the open/close valve is opened to guide the driving pressure of the rotating motor to the relief valve. Then, the relief valve is opened with the driving pressure of the rotating motor to guide residual oil of the rotating motor to the hydraulic motor.

SUMMARY OF THE INVENTION

With the relief valve that changes the setting pressure by actuating the auxiliary piston as described above, in most cases, only two-alternative controls, a high pressure and a low pressure one of which can be selected as the setting pressure, can be performed. In other words, there is a problem that the setting pressure of the relief valve cannot be linearly controlled.

There is also a problem with the construction machine that residual oil of the rotating motor cannot be efficiently used while linearly determining a change in the driving pressure of the rotating motor.

It is a first object of the invention to provide a circuit pressure control unit that can linearly control a circuit pressure.

It is a second object of the invention to provide a hydraulic control circuit where a residual energy of an actuator to be controlled can be efficiently utilized for another actuator.

According to one aspect of the first invention, a circuit pressure control unit includes a relief valve connected to a connecting passage communicating with an actuator upstream, and a variable throttle valve disposed upstream of the relief valve, and is configured to change an opening degree thereof according to a control signal from a controller.

According to one aspect of the second invention, a hydraulic control circuit for controlling the actuator, wherein an upstream of the variable throttle valve in the circuit pressure control unit is connected to the connecting passage, the connecting passage communicating between the variable throttle valve and the actuator to be controlled by pressure, and the relief valve is connected to an downstream of the variable throttle valve, an downstream of the relief valve being connected to a supply passage, the supply passage communicating between the relief valve and an actuator other than the actuator to be controlled, the variable throttle valve and the relief valve controlling a circuit pressure of a system of the actuator to be controlled side.

According to one aspect of the third invention, a hydraulic control circuit for a construction machine, the hydraulic control circuit, includes a rotating motor, a hydraulic pump as a pressure source of the rotating motor, and an operation valve disposed between the rotating motor and the hydraulic pump, an upstream of the operation valve being connected to the hydraulic pump or a tank, a downstream of the operation valve being connected to the rotating motor, wherein the variable throttle valve in the circuit pressure control unit has an upstream that is connected to a connecting passage, the connecting passage connecting the operation valve to the rotating motor, and the relief valve has a downstream that is connected to a supply passage, the supply passage connecting the relief valve to a hydraulic motor for rotating an electric generator.

PREFERRED EMBODIMENT OF THE INVENTION

Figure 1:
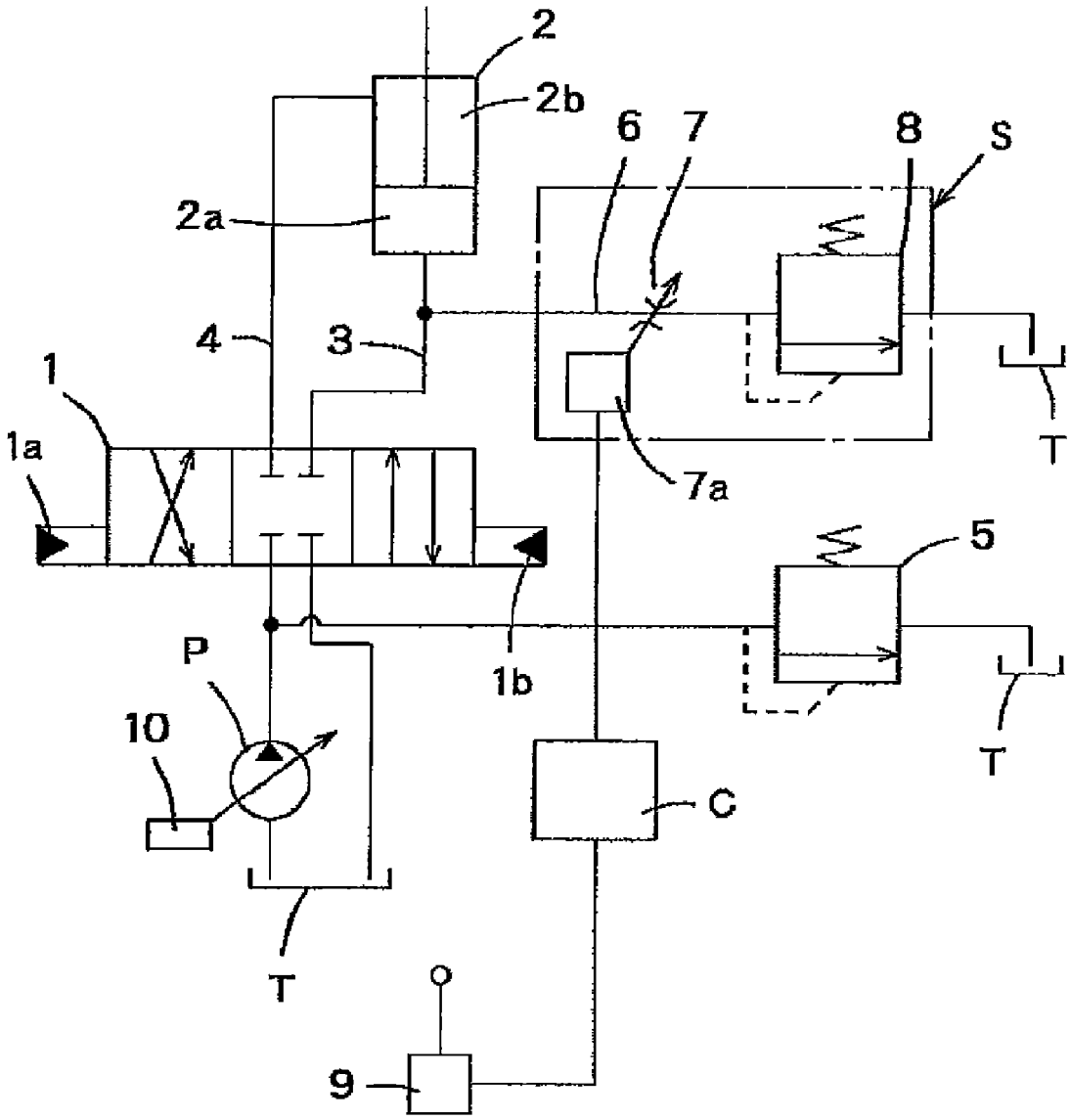
FIG. 1 is a circuit diagram illustrating a circuit pressure control unit according to a first embodiment of the present invention.

The first embodiment illustrated in FIG. 1 is a hydraulic circuit where a variable capacity type hydraulic pump P and a tank T are connected to a cylinder 2, which is an actuator, via an operation valve 1. In this embodiment, when the operation valve 1 is held at a neutral position, communications between the hydraulic pump P and the tank T, and the cylinder 2 are cut off.

When the operation valve 1 is switched from the neutral position to a switch position, which is one of right and left positions, the hydraulic pump P communicates with one of a piston side chamber 2*a* and a rod side chamber 2*b* of the cylinder 2 via a connecting passage 3 or 4. Accordingly, the tank T communicates with one of the rod side chamber 2*b* or the piston side chamber 2*a* of the cylinder 2 via the connecting passage 4 or 3. This extends or retracts the cylinder 2.

The hydraulic pump P and the operation valve 1 are connected by a hydraulic passage. A branch passage is branched from the hydraulic passage. The branch passage includes a main relief valve 5. Opening or closing the main relief valve 5 controls pressure supplied from the hydraulic pump P to the entire circuit.

The branch passage 6, which is connected to the tank T, is connected to the connecting passage 3, which couples the operation valve 1 and the piston side chamber 2*a* of the cylinder 2. The branch passage 6 includes a variable throttle valve 7 and a relief valve 8 in order from upstream.

The variable throttle valve 7 and the relief valve 8 constitute a circuit pressure control unit S of the present invention.

The variable throttle valve 7 includes an electromagnetic mechanism 7*a*. In the variable throttle valve 7, the electromagnetic mechanism 7*a* actuates according to an electrical signal from a controller C, and an opening degree of the variable throttle valve 7 is adjusted. The variable throttle valve 7 is controlled by the controller C. A joystick 9 is connected to the controller C. When the operator operates the joystick 9, a predetermined operation signal is input to the controller C at every operation of the joystick 9. The controller C actuates the electromagnetic mechanism 7*a* according to the operation signal to control the opening degree of the variable throttle valve 7. Thus, the variable throttle valve 7 changes the opening degree according to the control signal, which controls the electromagnetic mechanism 7*a*, from the controller C.

The joystick 9 is to operate pilot pressure guided to pilot chambers la and lb of the operation valve 1. The control signal input to the electromagnetic mechanism 7*a* of the variable throttle valve 7 is proportional to a switch amount of the operation valve 1.

The relief valve 8 includes a spring. In the relief valve 8, an upper limit value of the pressure on the upstream is set by the spring force of the spring. In this embodiment, the setting pressure of the relief valve 8 is set lower than the setting pressure of the main relief valve 5.

A plurality of actuators, which is not shown, is connected to the hydraulic pump P according to the first embodiment. The plurality of actuators are connected to one another via a hydraulic circuit, which is not shown. The hydraulic pump P includes a regulator 10 that controls the discharge amount of the hydraulic pump P. This regulator 10 controls the tilt angle of the hydraulic pump P.

Next, an action of this embodiment will be described.

Operating the operating lever of the joystick 9 allows the controller C to output a control signal proportional to an operation amount of the operating lever. Then, when pilot pressure according to the control signal is introduced in the pilot chamber 1*a* of the operation valve 1, the operation valve 1 is switched from the neutral position to the left position in the drawing according to the control signal from the controller C.

As described above, when the operation valve 1 is switched to the left position in the drawing, discharge oil of the hydraulic pump P is supplied to the piston side chamber 2*a* of the cylinder 2 and the return oil of the rod side chamber 2*b* is returned to the tank T.

Then, the operator actuates the controller C to change the setting pressure of the hydraulic circuit by the circuit pressure control unit S. That is, by operation by the operator, the circuit pressure control unit S changes the pressure of the connecting passage 3 and the branch passage 6 to increase and decrease pressure supplied to the cylinder 2.

For example, when setting the lowest setting pressure, the control signal to set the opening degree of the variable throttle valve 7 to maximum is output from the controller C. With the maximum opening degree of the variable throttle valve 7, the setting pressure of the hydraulic circuit including the cylinder 2 is set to the setting pressure of the relief valve 8, which is a relatively low setting pressure, by the circuit pressure control unit S.

Alternatively, the smaller the opening degree of the variable throttle valve 7 becomes, the higher the setting pressure of the hydraulic circuit by the circuit pressure control unit S can be maintained.

For example, in the case where the opening degree of the variable throttle valve 7 is decreased, load pressure of the cylinder 2 is applied to the relief valve 8 via the variable throttle valve 7. That is, the higher the load pressure of the cylinder 2 becomes, the higher the pressure at the upstream of the relief valve 8 becomes.

Accordingly, in the case where the opening degree of the variable throttle valve 7 is decreased, the relief valve 8 opens when the load pressure of the cylinder 2 reaches the setting pressure of the relief valve 8.

When the relief valve 8 opens, a flow occurs in the branch passage 6. Therefore, pressure loss occurs before and after the variable throttle valve 7. If pressure loss thus occurs at before and after the variable throttle valve 7, pressure occurs at the upstream of the variable throttle valve 7. This pressure practically becomes the setting pressure in the circuit of the cylinder 2.

Accordingly, the setting pressure of the hydraulic circuit upstream of the circuit pressure control unit S can be linearly controlled in a range from the lowest setting pressure of the relief valve 8 (the lower limit value) to the largest setting pressure determined according to the opening degree of the variable throttle valve 7 (the upper limit value).

Thus, the setting pressure of the hydraulic circuit in communication with the cylinder 2 can be linearly controlled. For example, if a load of the cylinder 2 is small, the setting pressure is maintained low to reduce a load of to the hydraulic pump P. Obviously, the setting pressure can also be controlled in the case where the load of the cylinder 2 is large.

With the circuit pressure control unit S according to the first embodiment of the present invention, the setting pressure can be variably-controlled linearly with the variable throttle valve and the relief valve. Accordingly, the setting pressure of the actuator to be controlled can be finely controlled according to a condition.

Next, a second embodiment of the present invention will be described.

Figure 2:
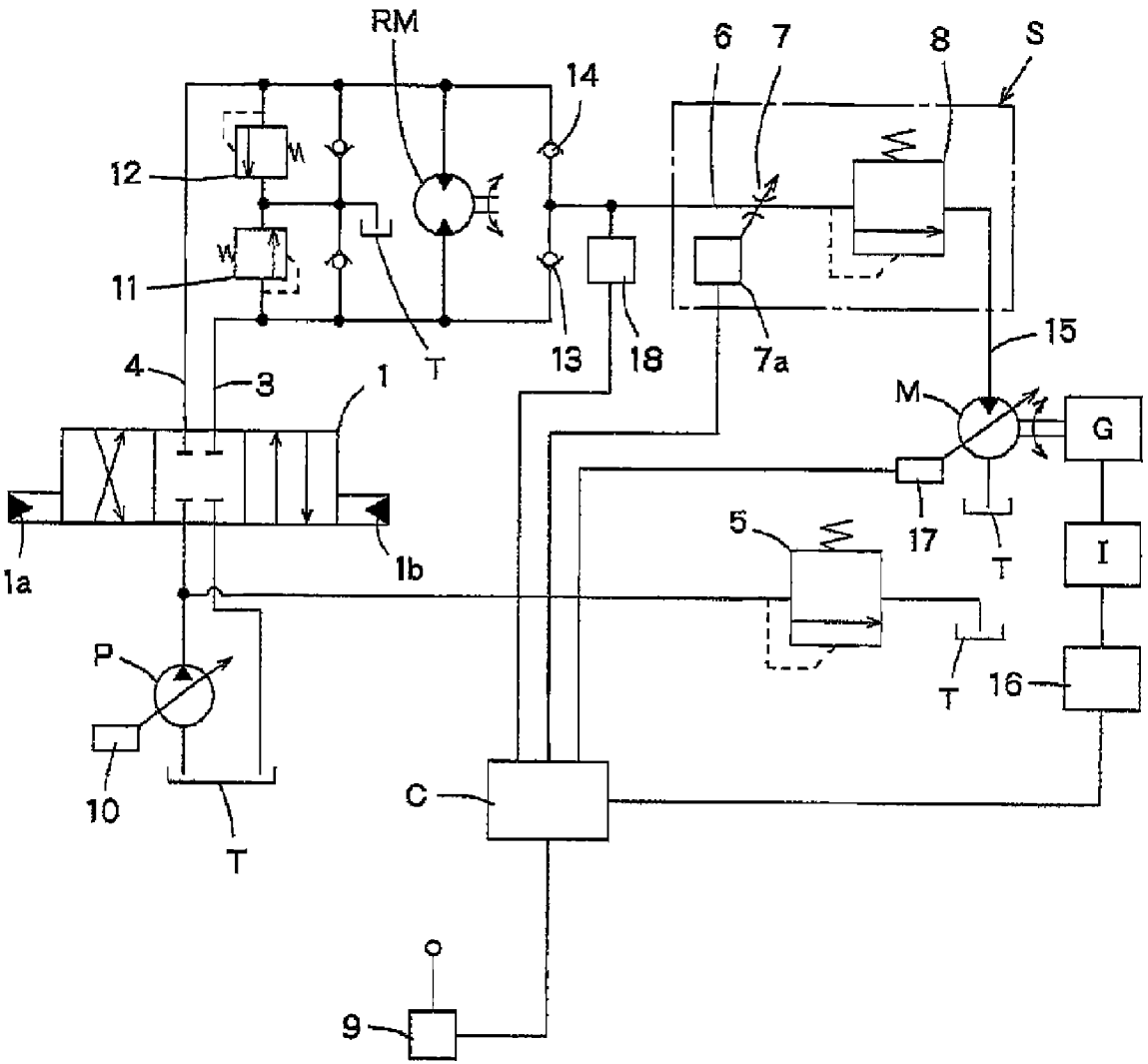
FIG. 2 is a circuit diagram illustrating a hydraulic control circuit of construction equipment according to a second embodiment.

FIG. 2, which illustrates the second embodiment, is a circuit diagram focusing on a rotating motor RM among control circuits of a construction machine. Hence, in the second embodiment, an illustration of another actuator used for the construction machine is omitted.

In the second embodiment, the same components as in the first embodiment are identified with the same reference numeral as in the first embodiment and are described.

The rotating motor RM is connected to the operation valve 1 for controlling a rotating motor via the connecting passages 3 and 4. Brake valves 11 and 12 are connected to the respective connecting passages 3 and 4. When the operation valve 1 is held at the neutral position, the rotating motor RM remains in a stopped state.

If the operation valve 1 is switched from the above-described state, for example, from the neutral position to the left position in the drawing, one connecting passage 3 is connected to the hydraulic pump P while another connecting passage 4 communicates with the tank T. Accordingly, pressure oil is supplied from the connecting passage 3, the rotating motor RM rotates, and an return oil from the rotating motor RM is returned to the tank via the other connecting passage 4.

If the operation valve 1 is switched to the direction opposite to the direction described above, this time, discharge oil from the hydraulic pump P is supplied to the connecting passage 4, the connecting passage 3 communicates with the tank T, and the rotating motor RM rotates inversely.

As described above, while the rotating motor RM drives, the brake valve 11 or 12 serves as a relief valve. When the connecting passages 3 and 4 are equal to or more than the setting pressure, the brake valves 11 and 12 open to control pressure of the passage at a high pressure side within the setting pressure.

Even if the operation valve 1 is returned to the neutral position and is closed while the rotating motor RM is rotating, the rotating motor RM continues rotating by the inertial energy and the rotating motor RM acts as a pump. At this time, the connecting passages 3 and 4, the rotating motor RM, and the brake valve 11 or 12 constitute a closed circuit. Additionally, the inertial energy of the rotating motor RM is converted into heat energy with the brake valves 11 and 12.

The connecting passages 3 and 4 join together via respective check valves 13 and 14. A supply passage 15 is connected to this junction. It should be noted that the respective check valves 13 and 14 allow only a flow from the connecting passages 3 and 4 to the supply passage 15.

A variable capacity type hydraulic motor M is connected to the most downstream of the above-described supply passage 15. The hydraulic motor M links an electric generator G. The electric generator G is connected to a battery 16 via an inverter I. The battery 16 is connected to the controller C via a signal line to detect a state of the battery 16. In view of this, the controller C can grasp a charge state of the battery 16.

A tilt angle controller 17 is disposed at the hydraulic motor M. The tilt angle controller 17 electrically controls the tilt angle of the hydraulic motor M. The tilt angle controller 17 is connected to the controller C via the signal line.

The circuit pressure control unit S is disposed at the supply passage 15 as described above. This circuit pressure control unit S includes the variable throttle valve 7 and the relief valve 8. The variable throttle valve 7 includes the electromagnetic mechanism 7*a*. The relief valve 8 is disposed downstream of the variable throttle valve 7. The variable throttle valve 7 and relief valve 8 are the same as those of the first embodiment. The setting pressure when the variable throttle valve 7 opens somewhat is set to be lower than the setting pressure of the brake valves 11 and 12.

A pressure sensor 18 is disposed upstream of the variable throttle valve 7. The pressure sensor 18 detects pressure while the rotating motor RM is rotating or pressure when a brake is applied. The pressure signal of the pressure sensor 18 is input to the controller C.

It should be noted that the regulator 10, which is the same as that of the first embodiment, is disposed at the hydraulic pump P.

Next, an action of the second embodiment will be described.

If the operation valve 1 is switched, for example, from the neutral position to one of right and left switch positions, the rotating motor RM rotates in a range of the setting pressure of the brake valves 11 and 12 as described above.

The load pressure of the rotating motor RM at this time is detected by the pressure sensor 18 and is input to the controller C. The switch amount of the operation valve 1 is input to the controller C as the operation amount of the joystick 9.

The controller C compares a difference between the setting pressure of the brake valves 11 and 12 and the load pressure of the rotating motor RM, and determines whether the load pressure exceeds a threshold value preset to the controller C or not.

The controller C controls opening and closing of the variable throttle valve 7 according to the load pressure of the rotating motor RM and the above-described threshold value. That is, if the load pressure of the rotating motor RM exceeds the threshold value, the controller C actuates the electromagnetic mechanism 7*a* to decrease the opening degree of the variable throttle valve 7 or to close the variable throttle valve 7. Thus, the opening degree of the variable throttle valve 7 is decreased, the setting pressure of the hydraulic circuit is set high by the circuit pressure control unit S, and the variable throttle valve 7 is fully closed. This maximizes the setting pressure of the circuit. Accordingly, the rotating motor RM can be driven in the range of the setting pressures of the brake valves 11 and 12.

On the other hand, if the controller C determines that the load pressure of the rotating motor RM is equal to or less than the threshold value, the controller C drives the electromagnetic mechanism 7*a* to open the variable throttle valve 7. Pressure of when the variable throttle valve 7 opens also opens the relief valve 8, the extra flow rate of the rotating motor RM is supplied to the hydraulic motor M via the supply passage 15, thus making the hydraulic motor M rotate. Thus, rotation of the hydraulic motor M rotates the electric generator G, and electricity is generated. Then, the generated electric power is charged in the battery 16 via the inverter I.

Then, the controller C controls the opening degree of the variable throttle valve 7 based on the difference between the above-described required flow rate and the threshold value. If the variable throttle valve 7 is fully open, the setting pressure of the circuit pressure control unit S, which includes the variable throttle valve 7 and the relief valve 8, becomes the lowest. If the variable throttle valve 7 is fully closed, the highest setting pressure of the hydraulic circuit is set by the circuit pressure control unit S.

A larger amount of flow rate can be supplied to the hydraulic motor M as the setting pressure of the circuit is lowered by the circuit pressure control unit S. In contrast, a flow rate supplied to the hydraulic motor M is reduced by the amount of an increase in the setting pressure of the circuit by the circuit pressure control unit S.

It should be noted that the opening degree of the variable throttle valve 7 may be directly controlled by the operator or may be automatically controlled by the controller C.

To change the setting pressure of the circuit by the circuit pressure control unit S, controlling the opening degree of the variable throttle valve 7 is enough. Therefore, the setting pressure of the circuit can be variably-controlled linearly. Thus, variable control can be performed linearly. Residual oil that changes according to the actuation condition of the rotating motor RM can be appropriately supplied to the hydraulic motor M. Energy efficiency can be increased, enabling energy saving to that extent.

Based on the tilt angle signal of the tilt angle controller 17 of the hydraulic motor M, the controller C can control the opening degree of the variable throttle valve 7. For example, when the controller C determines that the battery 16 is fully charged based on a signal regarding the amount of charge input from the battery 16 to the controller C, the tilt angle controller 17 is actuated and the tilt angle of the hydraulic motor M is set to approximately zero. In this state, the controller C fully closes the variable throttle valve 7 to prioritize driving of the rotating motor RM.

In any cases, the controller C can variably-control the setting pressure of the circuit linearly by the circuit pressure control unit S in combination with a pressure signal from the pressure sensor 18, the tilt angle signal from the tilt angle controller 17 of the hydraulic motor M, or similar signal.

It should be noted that the second embodiment is applicable not only to the case where residual oil is supplied to the hydraulic motor M for electric generation but is also naturally applicable to the case where residual oil is supplied to another equipment.

The actuator to be controlled is applicable to not only the rotating motor RM but also all general equipment.

With the second embodiment according to the present invention, residual energy that changes according to the actuation condition of the actuator to be controlled can be appropriately supplied to another actuator. Energy efficiency can be increased, enabling energy saving to that extent.

With the second embodiment, residual energy that changes according to a change in the driving pressure of the rotating motor can be supplied to the hydraulic motor for rotating the electric generator. For example, for rotation to the lower direction of a slope, the rotation pressure may be low. In this case, the opening degree of the variable throttle valve is relatively increased to guide the large amount of residual oil to the hydraulic motor.

In contrast, for rotation to the higher direction of the slope, the rotation pressure has to be high. Accordingly, the opening degree of the variable throttle valve is reduced relatively to prioritize actuation of the rotating motor. In this case, residual oil supplied to the hydraulic motor is reduced.

Thus, the flow rate of the residual oil supplied to the hydraulic motor can be controlled according to the actuation condition of the rotating motor. Therefore, without interfering driving efficiency of the rotating motor, the hydraulic motor can be effectively rotated and electric generation efficiency can be increased.

Embodiments of this invention were described above, but the above embodiments are merely examples of applications of this invention, and the technical scope of this invention is not limited to the specific constitutions of the above embodiments.

This application claims priority based on Japanese Patent Application No. 2012-013186 filed with the Japan Patent Office on Jan. 25, 2012, the entire contents of which are incorporated into this specification.

Industrial Applicability

The circuit pressure control unit according to the present invention is applicable to a construction machine with the electricity generation function.

The invention claimed is:

1. A circuit pressure control unit, comprising:

a relief valve connected to a passage communicating with an actuator at an upstream side of the relief valve, the passage including a branch passage, the branch passage being branched from a connecting passage, the connecting passage connecting the actuator and an operation valve; and a variable throttle valve disposed in the branch passage upstream of the relief valve, the variable throttle valve being configured to change a degree of opening thereof according to a control signal from a controller.

2. The circuit pressure control unit according to claim 1, wherein the variable throttle valve is configured to decrease the degree of opening in response to the control signal for increasing a pressure supplied to the, and is configured to increase the degree of opening in response to the control signal for decreasing the pressure supplied to the actuator.

3. The circuit pressure control unit according to claim 1, wherein the controller is configured to increase the degree of opening of the variable throttle valve to set a load of the actuator to be small, and is configured to reduce the degree of opening of the variable throttle valve to set the load of the actuator to be large.

4. The circuit pressure control unit according to claim 1, wherein the controller is configured to change a pressure supplied to the actuator linearly when pressure upstream of the relief valve is higher than a setting pressure of the relief valve.

5. A hydraulic control circuit for controlling a pressure-controlled actuator, the hydraulic control circuit comprising a circuit pressure control unit, including:

a relief valve connected to a connecting passage communicating with the actuator to be controlled, the actuator to be controlled being disposed upstream of the relief valve; and a variable throttle valve responsive to a control signal from a controller to change a degree of opening of the variable throttle valve, the variable throttle valve being disposed upstream of the relief valve, wherein an upstream side of the variable throttle valve is connected to the connecting passage, the connecting passage communicating with the actuator to be controlled, and wherein the relief valve is connected to a downstream side of the variable throttle valve, and a downstream side of the relief valve is connected to a supply passage, the supply passage providing communication between the relief valve and an actuator other than the actuator to be controlled, the variable throttle valve and the relief valve controlling a circuit pressure of a system of the actuator to be controlled.

6. A hydraulic control circuit for a construction machine, the hydraulic control circuit comprising:

a rotating motor;

a hydraulic pump as a pressure source of the rotating motor;

an operation valve disposed between the rotating motor and the hydraulic pump, an upstream side of the operation valve being connected to the hydraulic pump or a tank, a downstream side of the operation valve being connected to the rotating motor; and a circuit pressure control unit, including:

a relief valve connected to a connecting passage communicating with the rotating motor, the rotating motor being disposed upstream of the relief valve; and a variable throttle valve responsive to a control signal from a controller to change a degree of opening of the variable throttle valve, the variable throttle valve being disposed upstream of the relief valve, wherein the variable throttle valve has an upstream side that is connected to the connecting passage, the connecting passage connecting the operation valve to the rotating motor, and wherein the relief valve has a downstream side that is connected to a supply passage, the supply passage connecting the relief valve to a hydraulic motor for rotating an electric generator.

* * * * *